United States Patent [19]

Manaugh

[11] 4,005,785

[45] Feb. 1, 1977

[54] ELEVATOR MECHANISM FOR MULTIPLE LEVEL MECHANICAL CAR PARKING STRUCTURE

[76] Inventor: Carlisle F. Manaugh, 522 Arbramar Ave., Pacific Palisades, Calif. 90272

[22] Filed: Aug. 11, 1975

[21] Appl. No.: 603,337

[52] U.S. Cl. ..... 214/16.1 EB; 214/16.4 A

[51] Int. Cl.[2] ..... B65G 47/00

[58] Field of Search ..... 214/16.1 R, 16.1 EB, 214/16.4 A; 187/9 R, 58, 11, 17, 24–25; 308/6 C

[56] References Cited

UNITED STATES PATENTS

| | | | |
|---|---|---|---|
| 281,632 | 7/1883 | Kidd | 187/58 |
| 479,314 | 7/1892 | Stearns | 187/25 |
| 2,268,800 | 1/1942 | Butzien | 187/9 R |
| 2,714,456 | 8/1955 | Manaugh | 214/16.1 EB |
| 2,951,599 | 9/1960 | Bogar | 214/16.1 EB |
| 3,190,703 | 6/1965 | Thomson et al. | 308/6 C |
| 3,468,401 | 9/1969 | Letz | 187/25 |
| 3,559,822 | 2/1971 | Lichtenford | 214/16.4 A |
| 3,817,398 | 6/1974 | Jones | 212/98 |

FOREIGN PATENTS OR APPLICATIONS

| | | | |
|---|---|---|---|
| 1,536,431 | 7/1968 | France | 187/17 |
| 520,101 | 3/1931 | Germany | 187/17 |
| 1,197,518 | 7/1970 | United Kingdom | 214/16.4 A |

OTHER PUBLICATIONS

Thomson Industries–Roundway Bearings and Ways; Rec'd 6/24/64; pp. 1–6, & 10.

*Primary Examiner*—L. J. Paperner
*Assistant Examiner*—R. B. Johnson
*Attorney, Agent, or Firm*—Keith D. Beecher

[57] ABSTRACT

An elevator mechanism is provided for use in a multiple tier car parking system and which is controllable to hoist the cars vertically to different levels of the structure and to move the cars horizontally at each level to different parking stalls or bins on the individual tiers. The elevator frame is supported on the second floor level of the structure, as described in U.S. Pat. No. 2,714,456, to permit it to pass over occupied ground level zones during its horizontal travel. The elevator platform is controlled by a usual elevator winch and counterweight assembly, and it also uses one or more vertical lead screw drives for auxiliary hoisting, floor levelling and safety redundancy purposes, to prevent sag of the platform, and for other purposes to be described. The frame is supported at the second floor level on horizontal rails by means of dual chain bearings which provide a line contact rather than a point contact with respect to the rails, and which are quieter than wheels and have no tendency to bind with respect to the rails, so that the elevator mechanism may be moved horizontally back and forth along the craneway. The bearings are free-wheeling, separate independent means being provided to drive the crane along the rails.

3 Claims, 9 Drawing Figures

FIG.5
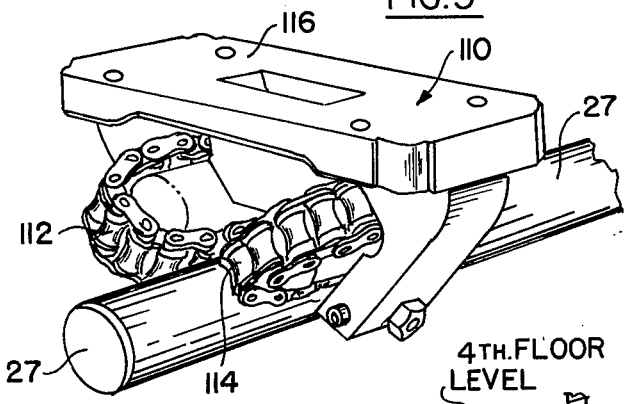
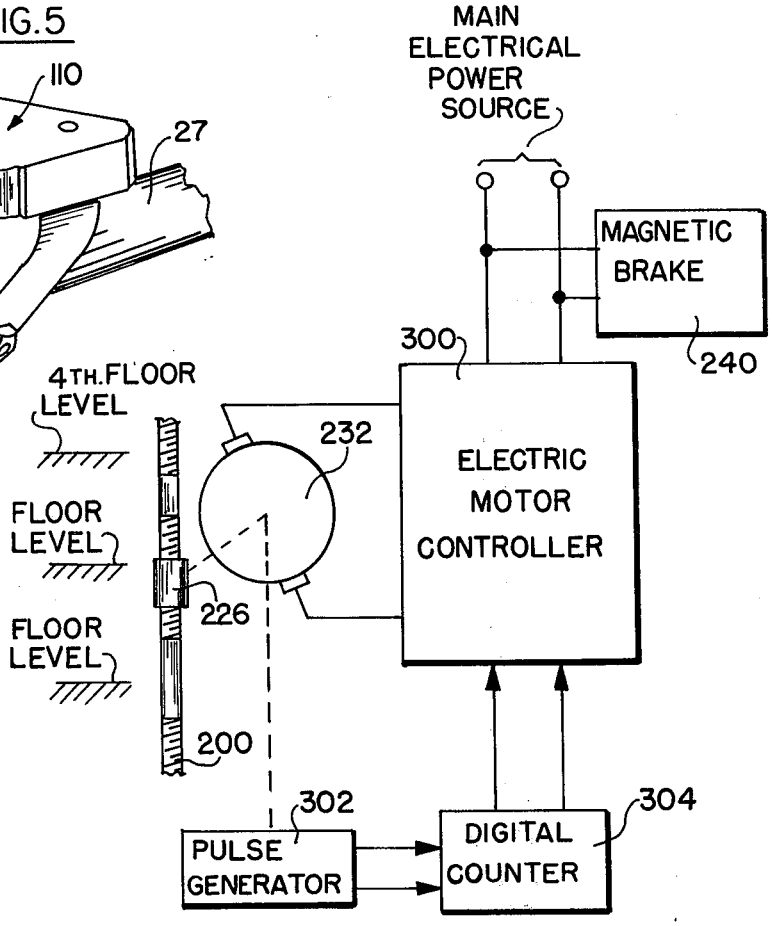
FIG. 9
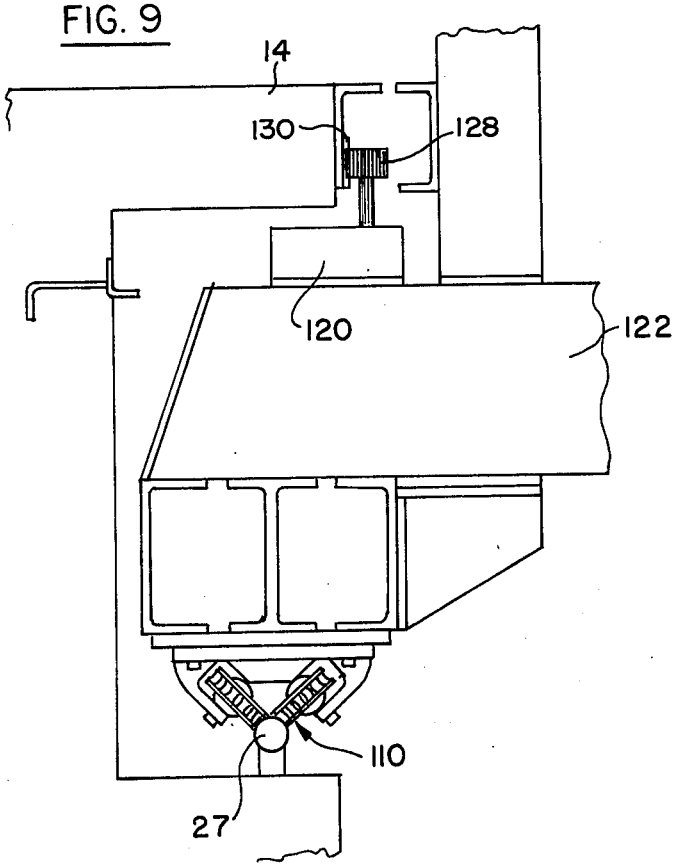
FIG.8
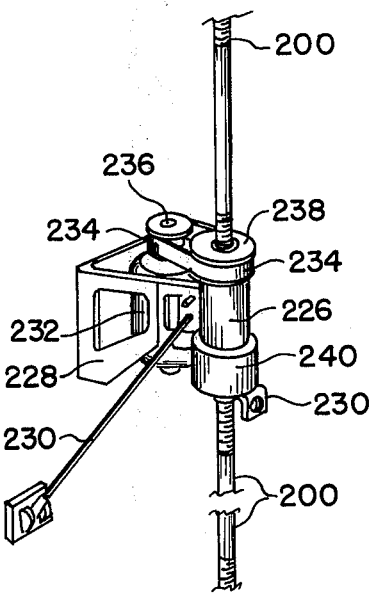
FIG. 7

ELEVATOR MECHANISM FOR MULTIPLE LEVEL MECHANICAL CAR PARKING STRUCTURE

BACKGROUND OF THE INVENTION

U.S. Pat. No. 2,714,456, referred to above, describes a mechanical parking system in which cars are loaded in stalls, or bins, on the various stories of a multi-tier parking unit, by a suitable crane mechanism. As pointed out in the patent, such systems are in general well known to the art, and usually utilize a crane-way running between two multi-story parking structures having a row of stalls on each floor to receive cars from elevator mechanisms which move vertically and horizontally in the crane-ways. In the structure described in the patent, elevator mechanisms are provided in the crane-ways which, are adapted to move both vertically and horizontally to service the various stalls on the different floors of the adjacent parking structures.

An entrance conveyor is provided in one of the crane-ways of the parking system described in the patent which is adapted to move cars from certain stalls of the ground floor of one parking unit, across the crane-way to the ground floor of a second parking unit. Similarly, exit conveyor means are provided in the system described in the patent in a second crane-way to move cars from certain stalls of the ground floor of the second parking unit across the second crane-way to the ground floor of a third parking unit. In order to accommodate the conveyor means in the system described in the patent, the elevator mechanisms are supported from one or more of the upper stories of the various parking units, so that the elevator mechanisms may move horizontally back and forth along the crane-ways and pass over the various conveyor means without interfering in any way with the conveyor means, or with cars transported thereby. The elevator mechanism of the present invention is similarly suspended above the ground floor of the parking unit, for the same reasons.

As mentioned above, the particular elevator mechanism of the present invention is mounted on chain-type bearings, as will be described, to facilitate horizontal movement of the elevator mechanism back and forth in the individual crane-ways without any tendency for it to bind or lock with the rails. Also, one or more vertical lead screws are provided in the elevator mechanism of the invention, in conjunction with the usual winch and counterweight components, to provide an auxiliary hoisting and redundancy safety means for the elevator, and for other reasons to be described.

BRIEF DESCRIPTION OF THE DRAWINGS

FIG. 5 is a perspective view of a type of chain bearing used to support the elevator frame on appropriate rates for horizontal movement of the frame within the corresponding crane-way;

FIG. 7 is a fragmentary representation of a vertical lead screw to of which are included in the elevator mechanism to be described, and of an appropriate drive mechanism for coupling the elevator platform to the lead screw;

FIG. 8 is a block diagram showing certain electrical controls which can be incorporated into the elevator mechanism of the invention; and FIG. 9 is a fragmentary detailed view, taken along the line 9—9 of FIG. 3, and showing a drive means for imparting reciprocal horizontal movement to the elevator frame along the craneway.

DETAILED DESCRIPTION OF THE ILLUSTRATED EMBODIMENT

Figure 1:
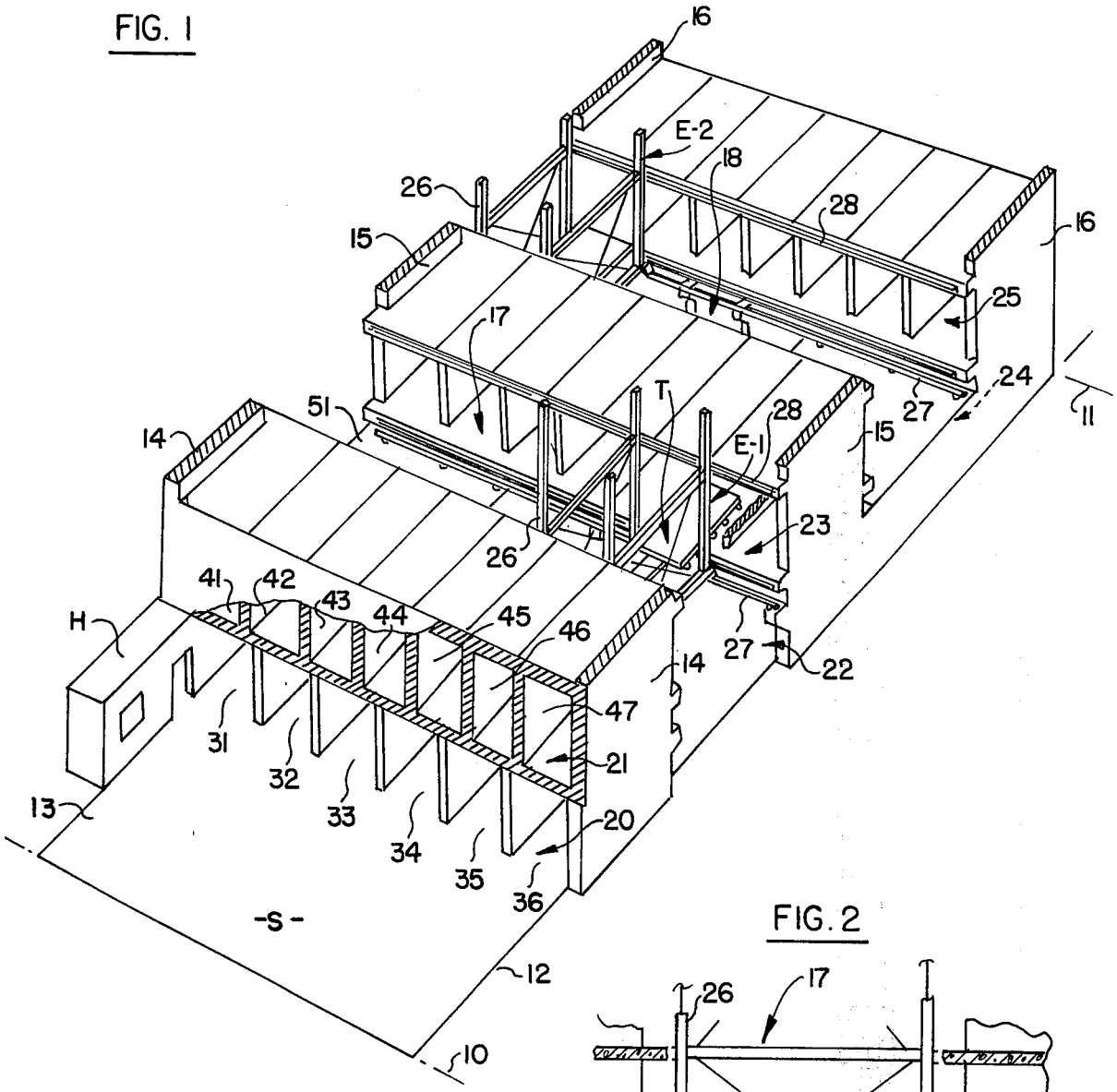
FIG. 1 is a diagrammatic view of a portion of an illustrative car parking system in which the elevator mechanism of the invention may be mounted.

Referring to FIG. 1, there is shown a parking lot bounded on its front by the boundary line 10 and its rear by the boundary line 11. The sides of the parking lot are confined by the boundary lines 12 and 13. By way of example only, the dimensions of the lot shown in FIG. 1 may be 60 feet by 140 feet, as indicated. The parking lot is somewhat narrower than the conventional area employed in downtown sections for parking automobiles.

In the illustrated layout, the parking system includes an open area or space S at the front entrance for manipulating cars. The construction itself is divided into three structural units 14, 15 and 16 of general rectangular shape disposed transversely of the lot and spaced from one another longitudinally of the lot. Between the first or forward and second or intermediate parking units 14 and 15 there is provided a first crane-way 17, and between the second or intermediate and third or rearward units 15 and 16 there is provided a second crane-way 18. As shown in FIG. 1, the crane-way 17 accomodates an elevator mechanism E-1 adapted to move vertically and horizontally within the crane-way as indicated by the arrows. Crane-way 18 accommodates a similar elevator mechanism E-2.

The first parking unit 14 comprises a ground floor 20 and multiple tiers, only one of which is shown at 21 for simplicity. Similarly, the second and third parking units, respectively, include a ground floor 22, and first tier 23, and other upper tiers, not shown; and a ground floor 24, first tier 25, and other upper tiers, not shown. Thus, while only one tier has been shown above each of the ground floors 20, 22 and 24, it is to be understood that any number of tiers may be provided on each unit. Also, it is to be understood that any number of such parking units may be provided spaced apart by further crane-ways, three parking units being shown for the particular illustrative lot.

Figure 2:
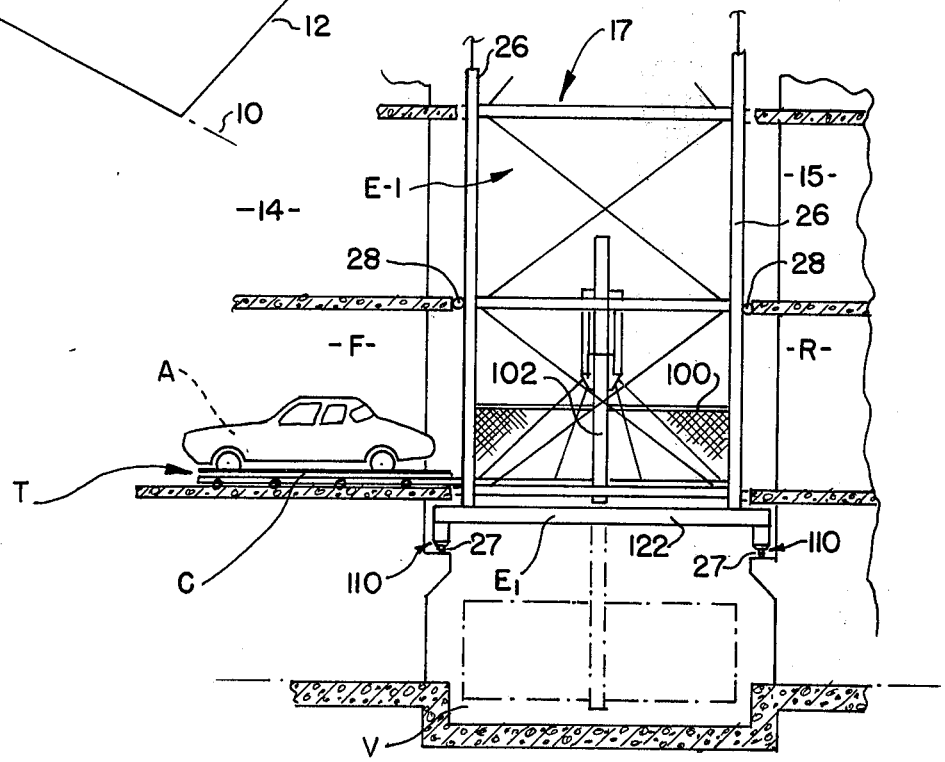
FIG. 2 is an enlarged elevational view showing the manner of operation of the elevator mechanism in one of the craneways of FIG. 1.

As shown in greater detail in FIG. 2, the elevator mechanism E-1 in the crane-way 17 is suspended from the first tiers or second stories of the first and second parking units 14 and 15, the reason for which will become clear as the description proceeds.

Positioned on the elevator platform is a traverse dolly T embodying a carriage C adapted first to move off the platform at ground level to reach under a car A, to elevate the car off the ground and to move it onto the elevator platform; and secondly to reach out into a selected stall on a selected upper tier, to lower the car onto the stall floor, and to return to the elevator platform. A presently preferred traverse dolly for accomplishing this is fully described and disclosed in Copending Application Ser. No. 656,309 filed Feb. 9, 1976, in the name of the present inventor and entitled "Self-Propelled Traverse Dolly."

Since the particular type of traverse dolly employed constitutes no part of the present invention, it is deemed unnecessary to describe its operation in detail. Suffice to say that the dolly mechanism is such that an automobile shown at A may be deposited into either a front stall F or a rear stall R in one or the other of the two parking units, and subsequently the car may be retrieved from the stall by a reverse operation. It will also be evident that this traverse dolly may be utilized to transport or convey an automobile across the crane-way from a front stall F to an opposed rear stall R.

The elevator mechanism E-1 is adapted to ride vertically in a supporting elevator frame 26, in the crane-way 17. Frame 26, in turn, is supported at its lower end on rails 27 extending longitudinally along the sides of the crane-way 17 at any level above the ground floors of the adjacent parking units. The frame is also supported on rails 28 which extend along each side of the crane-way at a higher level.

The construction is such that the platform of the elevator mechanism E-1 may be lowered through the bottom of frame 26 to service the ground floors of the various parking units. It will be noted that the ground level of the crane-way 17, as shown in FIG. 2, defines a sump or disposal area V designed to accomodate the platform of the elevator mechanism E-1 when it is lowered to the ground floor, so that the top of the elevator platform will be flush with the adjacent ground floor stalls.

Referring again to FIG. 1, the ground floor 20 of the first parking unit 14 comprises six entrance stalls 31, 32, 33, 34, 35 and 36. On the first tier 21 of the first parking unit there are accommodated seven parking stalls 41, 42, 43, 44, 45, 46 and 47. In one type of layout, there may be provided entrance conveyors operating into the stalls 31 and 32 for moving cars across the crane-way 17 directly into the second parking unit 15 adjacent the crane-way 18. The elevator mechanism E-1 may pass over these conveyors, and over any cars supported thereby, simply by raising its platform to the second story level. It is to permit this action that the frame 26 supporting the elevator platform is mounted on the second or higher stories.

The structural details of the crane or elevator mechanism E-1 in the crane-way 17 is shown in FIGS. 3–6. It will be appreciated, of course, that the elevator mechanism E-2 in the crane-way 25 may be similarly constructed.

Figure 4:
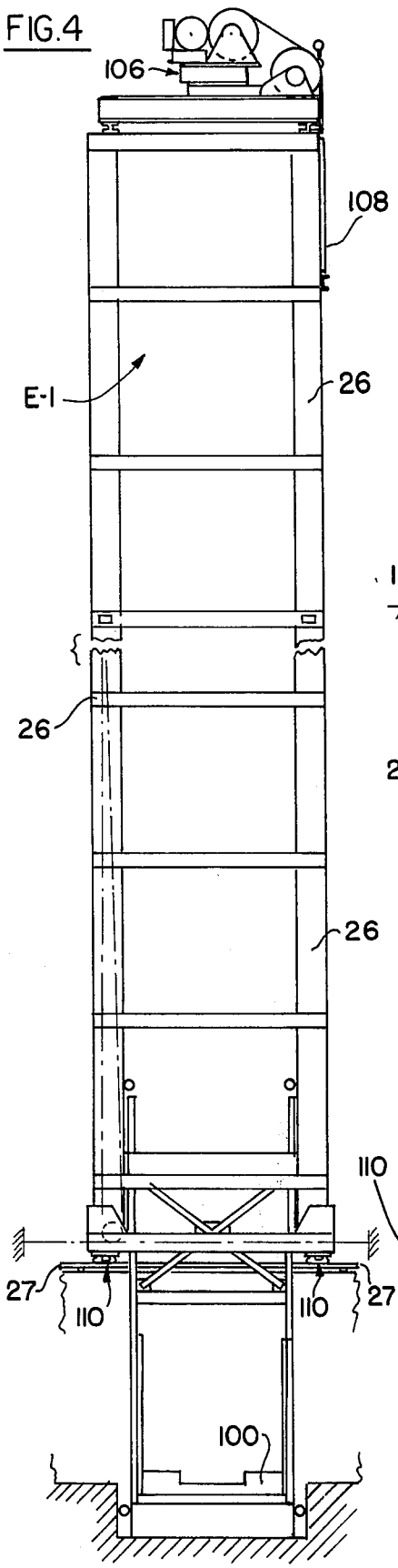
FIG. 4 is a side elevation, like FIG. 3, but turned 90° with respect to FIG. 3.
Figure 3:
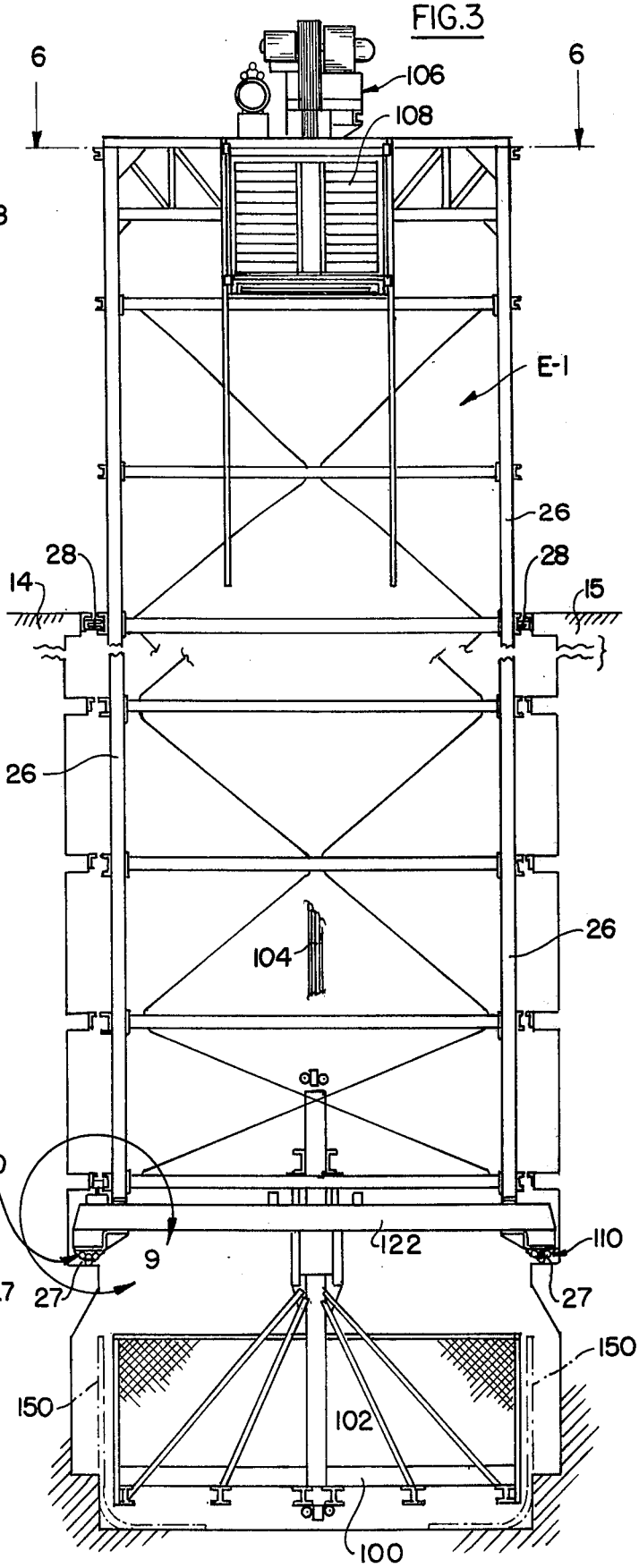
FIG. 3 is a side elevation of an elevator mechanism, constructed in accordance with one embodiment of the invention.

As shown in FIGS. 3 and 4, the elevator mechanism E-1 includes an elevator platform 100 which is supported in the elevator frame 26 by a sliding assembly 102 which, in turn, is suspended by cables 104. The cables extend around a usual winch drive mechanism 106 mounted on the top of the elevator frame. A usual counterweight 108 is also provided.

The frame 26 is supported on the rails 27 by endless chain bearings 110 which are shown in more detail in FIG. 5. As shown in FIG. 5, the chain bearings each includes two endless chain assemblies designated 112 and 114 which are pivotally mounted on a bracket 116, and which are angularly positioned with respect to one another. The endless chains 112 and 114 move along the rail 27 along spaced line contacts, rather than point contacts, as is the case with the usual wheels. The bearings 110 have no tendency whatever to bind or lock with the rails, and they provide a smooth free-wheeling bearing support for the frame on the rails. The bearings 110 may be of the type manufactured and sold by Thomson Industries, Inc., of Manhasset, New York, and designated by them as their "Roundway Bearings."

As mentioned above, the bearings 110 are free-wheeling, the frame being driven reciprocally along the rails 27 by means of a drive motor 120 mounted on the lower cross brace 122 of the frame 26 (FIG. 9). The motor 120 drives a pinion 128 which, in turn, engages a rack 130, the rack being mounted on the inner adjacent side of the parking unit 14. It will be clear that other drive means, such as chain and sprocket drives, or the like, may be used, and controlled by appropriate drive motors, so that the desired reciprocal horizontal movement of the crane mechanism within the corresponding crane-way may be achieved.

Gates 150 (FIG. 3) may be provided at the entrance to the elevator platform 100, and these gates may be opened and closed in any appropriate manner.

Figure 6:
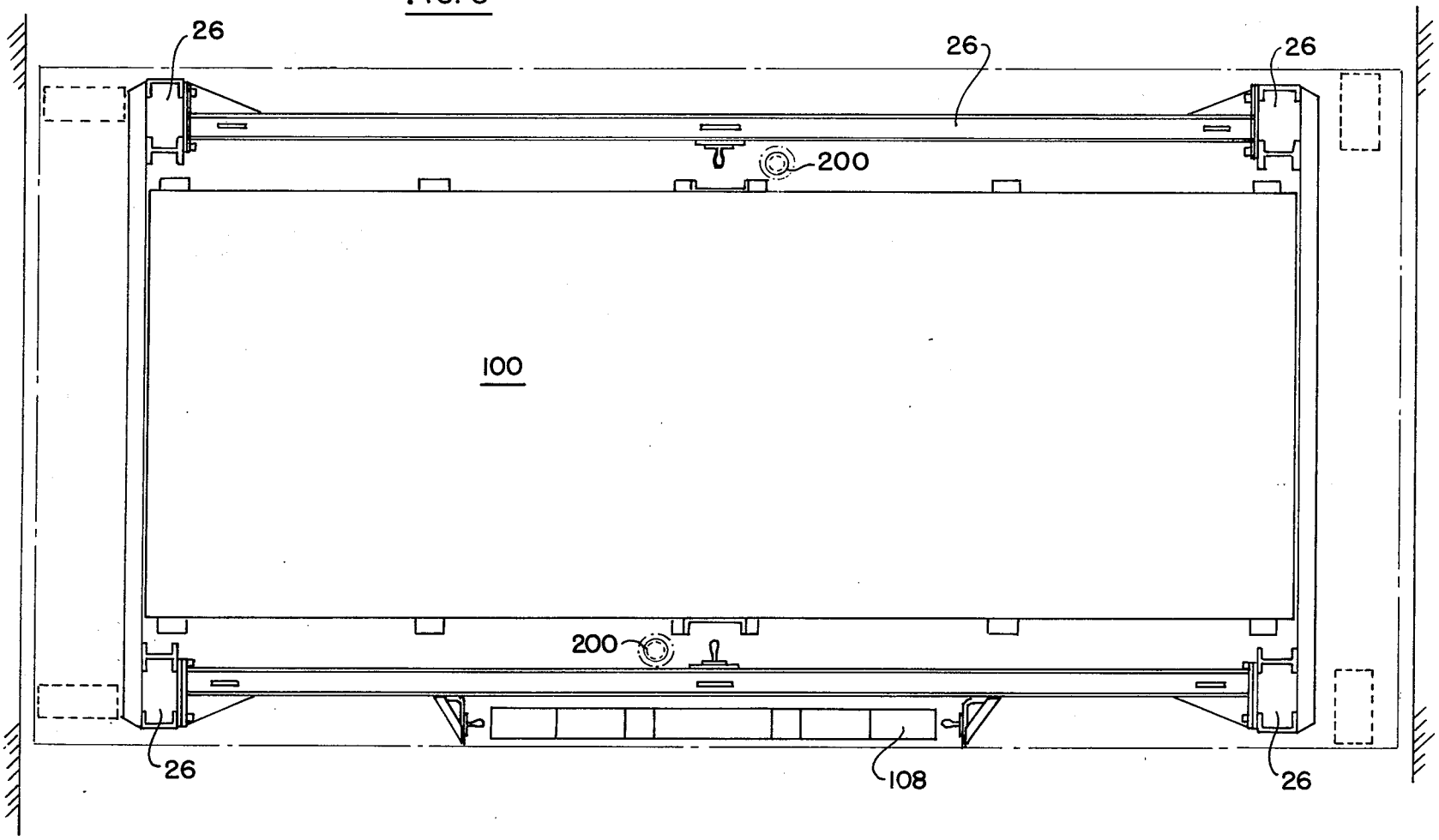
FIG. 6 is a top plan view of the elevator mechanism, taken essentially along the line 6—6 of FIG. 3.

As shown in FIG. 6, the elevator mechanism E-1 also includes a pair of vertically positioned lead screws 200. These lead screws may be mounted in the frame 26 in the manner described, for example, in Copending Application Ser. No. 314,178, which was filed in the name of the present invention on Dec. 11, 1972, and which has now issued as U.S. Pat. No. 3,881,575 and which contains a complete description of an elevator vertical lead screw drive mechanism.

A separate drive motor 232 (FIGS. 7 and 8) is mounted on the platform 100, and it is coupled to the vertical lead screws 200 by a belt 234. In the fragmentary view of FIG. 7, a single belt 234 is shown as coupling a drive pulley 236 on the drive shaft of the drive motor 232 to a pulley 238 on a nut assembly 226 on the screw 200. It will be appreciated however, that a similar belt may couple a similar pulley on the drive shaft of the motor 232 to a similar nut on the other lead screw 200.

As shown in FIG. 7, the nut assembly 226 threadably engages the screw 200, and it is supported on the elevator platform 100 by means, for example, of an appropriate bracket 228 and struts 230. The electric motor 232 is mounted within the bracket 228, and it is coupled to a rotating nut portion of the nut assembly 226 through the belt 234. The belt 234 may, for example, be of the type known as the "Poly-V" belt. Of course, other types of couplings, such as gear or direct coupling may be used between the drive motor and the nut assembly. The pulley 238 is coupled to an internal nut element within the nut assembly 226. The nut assembly 226 may be of the type described, for example, in U.S. Pat. No. 3,296,880. A magnetic brake 240 may also be mounted on the nut assembly 226. The magnetic brake may be power or spring actuated so as to clamp the nut against rotation on the vertical lead screw 200 whenever power is removed from both the winch drive mechanism 106 and the motor 232.

The lead screw drive is completely independent of the winch drive. However, as mentioned above, the lead screw drive of the elevator platform is used in conjunction with the usual winch drive as a redundant safety and auxiliary hoisting measure. It is evident that in the event of failure of the cable hoisting mechanism, hoisting can still be carried out by the lead screw mechanism. Also, the lead screws 200 serve to prevent sagging of the platform 100, even when it is heavily loaded. The lead screw and motor drive also serves an ancillary purpose, such as shown in FIG. 8, and which is also described in the copending application.

For example, for floor-levelling purposes, the motor 232 may be energized by means of a controller represented by the block 300 in FIG. 8. The controller may include the usual controls which cause the motor 232 to be energized, either for upward movement or downward movement of the elevator platform 100, and to cause the motor to stop automatically at a selected floor, so that the lead screw drive mechanism may be used for precise floor levelling purposes. It will be understood that for normal operation of the elevator, when the winch drive mechanism 106 is energized, the drive motor 232 is de-energized and the nut assembly 226 moves freely up and down the lead screw 200 as the elevator platform 100 is moved up and down the frame by the winch drive mechanism. The floor levelling control may be achieved, for example, by magnetically coupling a pulse generator 302 to the motor 232, and for applying the electric pulse output from the pulse generator 302 to a digital counter 304.

The digital counter is controlled by the pulse generator in a manner known to the art to count up or down, depending upon whether the elevator platform 100 is rising or dropping. The digital counter 304 provides an output which indicates exactly the vertical position of the platform 100 at any particular time. This output may be used, for example, in the control circuitry of the controller 300, so that whenever s floor is selected by, for example, a pushbutton selection, the platform will be moved up or down by the winch drive mechanism 106, with the nut assembly 226 free wheeling, until that floor is reached. Then, the motor 232, controlled by the controller 300, in response to the output from the digital counter 304, will control the platform, and will cause it to stop at a precisely levelled position with respect to the particular floor. The magnetic brake 240 will then be activated to hold the platform at that level.

The invention provides, therefore, an improved elevator mechanism for use in conjunction with a car parking structure, and which operates with a high degree of reliability and accuracy, to hoist the cars from the ground level, and to enable the cars to be deposited in different stalls at various elevated tiers of the adjacent parking structure.

Although a particular embodiment of the invention has been shown and described, modifications may be made. It is intended in the claims to cover the modifications which come within the spirit and scope of the invention.

What is claimed is:

1. In a multiple story mechanical car parking system, the combination of: a multiple story car storage structure having a crane-way adjacent the structure and extending transversely across a face of the structure and extending vertically from the ground floor level upwardly, said storage structure having on its stories above the ground level thereof rows of adjacent storage stalls opening to the crane-way; an elevator frame mounted in the frameway entirely above the first floor of the structure and extending upwardly toward the top of the structure; elongated rail means extending along the crane-way above the ground story of the structure for supporting the elevator frame above the ground storage; and plurality of bearing units mounting the frame on the rail means to permit reciprocal horizontal movement of the frame along the crane-way, each of said bearing units comprising dual pivotally mounted angularly displaced endless idler chain assemblies in spaced line engagement with said rail means; a drive motor coupled to the frame independent of said bearing units for imparting such reciprocal horizontal movement of the frame along the crane-way; an elevator platform mounted in the frame for vertical reciprocal movement within the frame; motor driven winch means mechanically coupled to the platform for imparting such vertical reciprocal movement to the platform; at least one vertical elongated screw member mounted in said frame; and auxiliary drive means independent of said motor driven winch means coupling said platform to the screw member for imparting vertical reciprocal movement to the platform within the frame.

2. The combination defined in claim 1, and which includes control means coupled to said auxiliary drive means to control the platform for floor levelling purposes.

3. The combination defined in claim 1, and which includes control means coupled to said auxiliary drive means to cause said auxiliary drive means to drive the platform in the event of failure of said motor driven winch means.

* * * * *